US008528130B2

(12) United States Patent
Bu et al.

(10) Patent No.: US 8,528,130 B2
(45) Date of Patent: Sep. 10, 2013

(54) PLAY YARD ASSEMBLY

(75) Inventors: Nan-Gui Bu, Hong Kong (HK); Lin-Zhen Zheng, Hong Kong (HK)

(73) Assignee: Wonderland Nurserygoods Company Limited, Central (HK)

( * ) Notice: Subject to any disclaimer, the term of this patent is extended or adjusted under 35 U.S.C. 154(b) by 137 days.

(21) Appl. No.: 12/910,618

(22) Filed: Oct. 22, 2010

(65) Prior Publication Data

US 2011/0197358 A1 Aug. 18, 2011

(30) Foreign Application Priority Data

Feb. 12, 2010 (CN) ..... 2010 1 0109368

(51) Int. Cl.
*A47D 7/00* (2006.01)

(52) U.S. Cl.
USPC ..... 5/93.1; 5/93.2; 5/655

(58) Field of Classification Search
USPC ..... 5/93.1, 655, 93.2
See application file for complete search history.

(56) References Cited

U.S. PATENT DOCUMENTS 5,349,709 A 9/1994 Cheng
2002/0092094 A1 7/2002 Welsh, Jr.
2003/0046761 A1 3/2003 Hsia
2009/0077738 A1 3/2009 Burns et al.
2009/0077739 A1* 3/2009 Mendes et al. ..... 5/93.1

FOREIGN PATENT DOCUMENTS

EP 1878364 A1 1/2008
GB 1416497 12/1975
GB 2452394 A 4/2009

OTHER PUBLICATIONS

European Search Report, European Patent Office, Apr. 29, 2011.

* cited by examiner

*Primary Examiner* — Peter M Cuomo
*Assistant Examiner* — Brittany Wilson
(74) *Attorney, Agent, or Firm* — Polsinelli PC

(57) ABSTRACT

A play yard assembly comprises a frame and a bassinet. The frame includes a frame head, a frame tail, and left and right side portions connected between the frame head and the frame tail to define an accommodating space thereamong. The bassinet has a head end, a tail end, a bed bottom connected between the head end and the tail end. The head end is positionable relative to the frame at a first height position and a second height position higher than the first height position. The bed bottom has a first end portion connected to the tail end, and a second end portion connected to the head end. The second end portion of the bed bottom is higher than that of the first end portion of the bed bottom when the head end is disposed at the second height position.

11 Claims, 7 Drawing Sheets

PLAY YARD ASSEMBLY

CROSS-REFERENCE TO RELATED APPLICATION

This application claims priority of Chinese Application No. 20101010109368.3, filed on Feb. 12, 2010.

BACKGROUND OF THE INVENTION

1. Field of the Invention

This invention relates to a play yard, and more particularly to a play yard having a bassinet.

2. Description of the Related Art

A conventional play yard (e.g., disclosed in Chinese Utility Model No. CN2549839Y) includes a frame defining a baby-receiving space, and a bassinet connected removably to the frame and disposed within an upper portion of the baby-receiving space. When the bassinet is removed from the frame, a baby can play or stand within the baby-receiving space. When the bassinet is connected to the frame, since the baby is at a high level, it can be taken out of and put into the play yard conveniently.

Further, to make such a play yard more convenient, the bassinet can be designed to be adjustable in height in the play yard. A conventional play yard having such design, however, allows a baby to be within the bassinet in only a horizontal state. To provide an enhanced comfort to the baby, it is desirable that a bed of the bassinet of the play yard is adjustable to raise the head of the baby when the baby is in the bassinet.

SUMMARY OF THE INVENTION

One object of this invention is to provide a play yard assembly that includes a bassinet, which is adjustable to raise the head of a baby when the baby lies on the bassinet.

Accordingly, a play yard assembly of this invention comprises a frame and a bassinet. The frame includes a frame head, a frame tail, and left and right side portions connected between the frame head and the frame tail to define an accommodating space thereamong. The bassinet has a head end, a tail end, a bed bottom connected between the head end and the tail end. The head end is positionable relative to the frame at a first height position and a second height position higher than the first height position. The bed bottom has a first end portion connected to the tail end, and a second end portion connected to the head end. The second end portion of the bed bottom is higher than that of the first end portion of the bed bottom when the head end is disposed at the second height position.

As such, when the head end is moved from the first height position to the second height position, the head of a baby lying on the bassinet is raised to a position above the feet of the baby.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
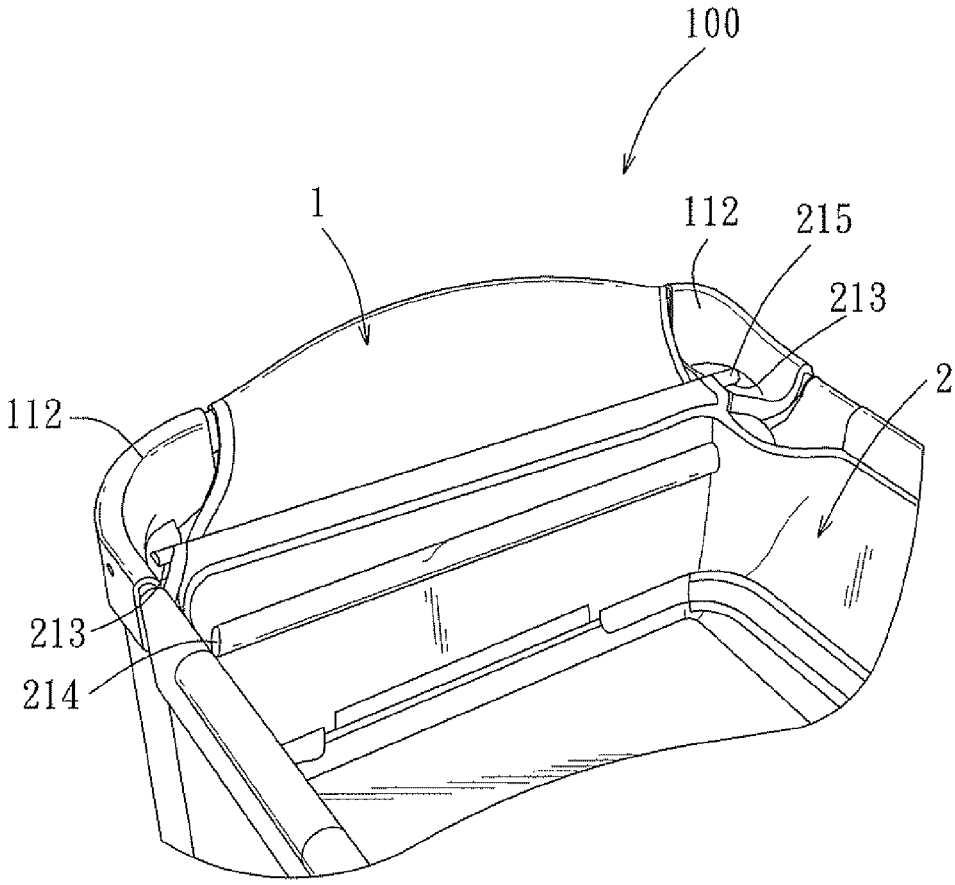
FIG. 1 is a fragmentary perspective view of the first preferred embodiment of a play yard assembly according to this invention.
Figure 2:
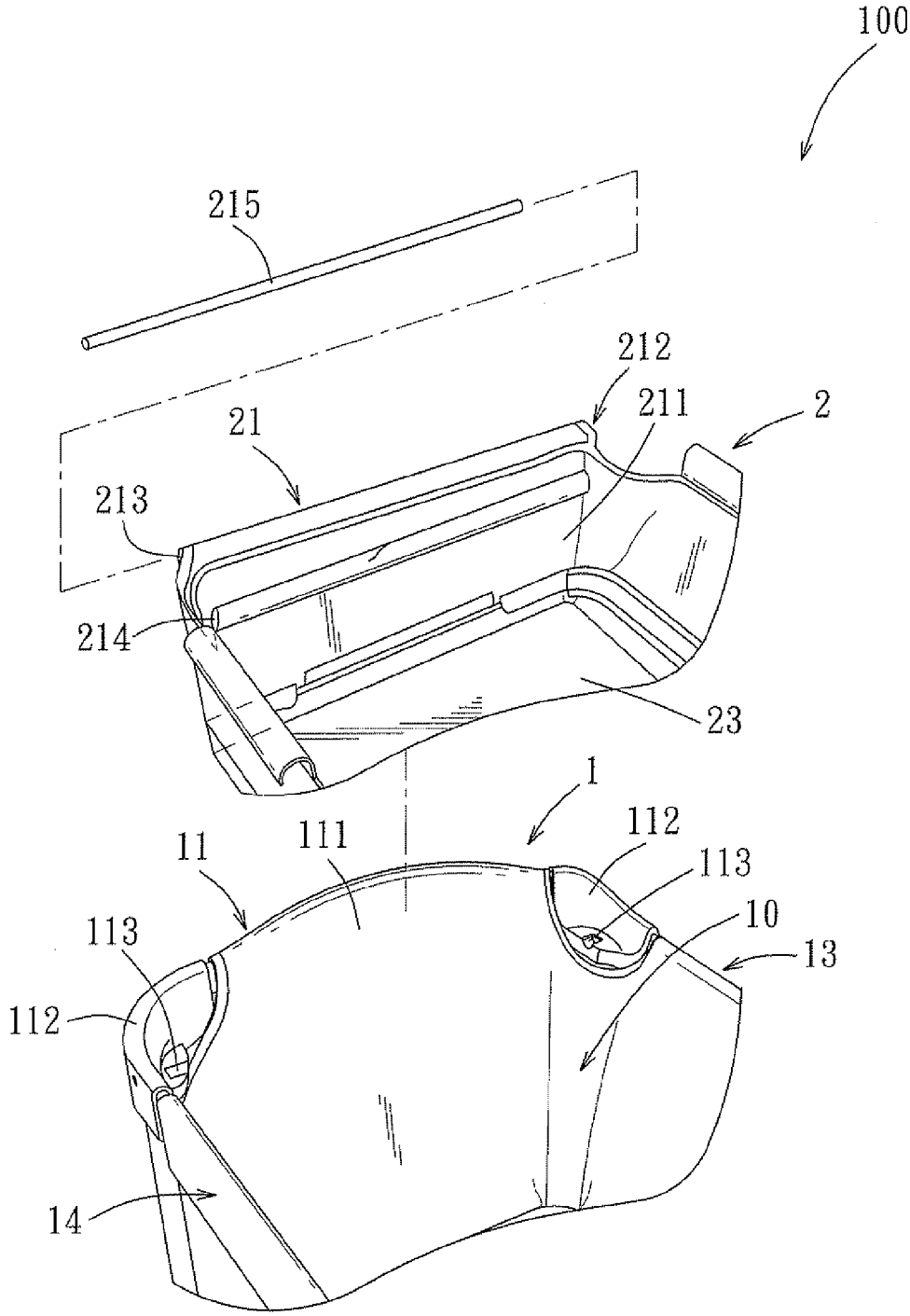
FIG. 2 is a fragmentary, exploded perspective view of the first preferred embodiment.
Figure 3:
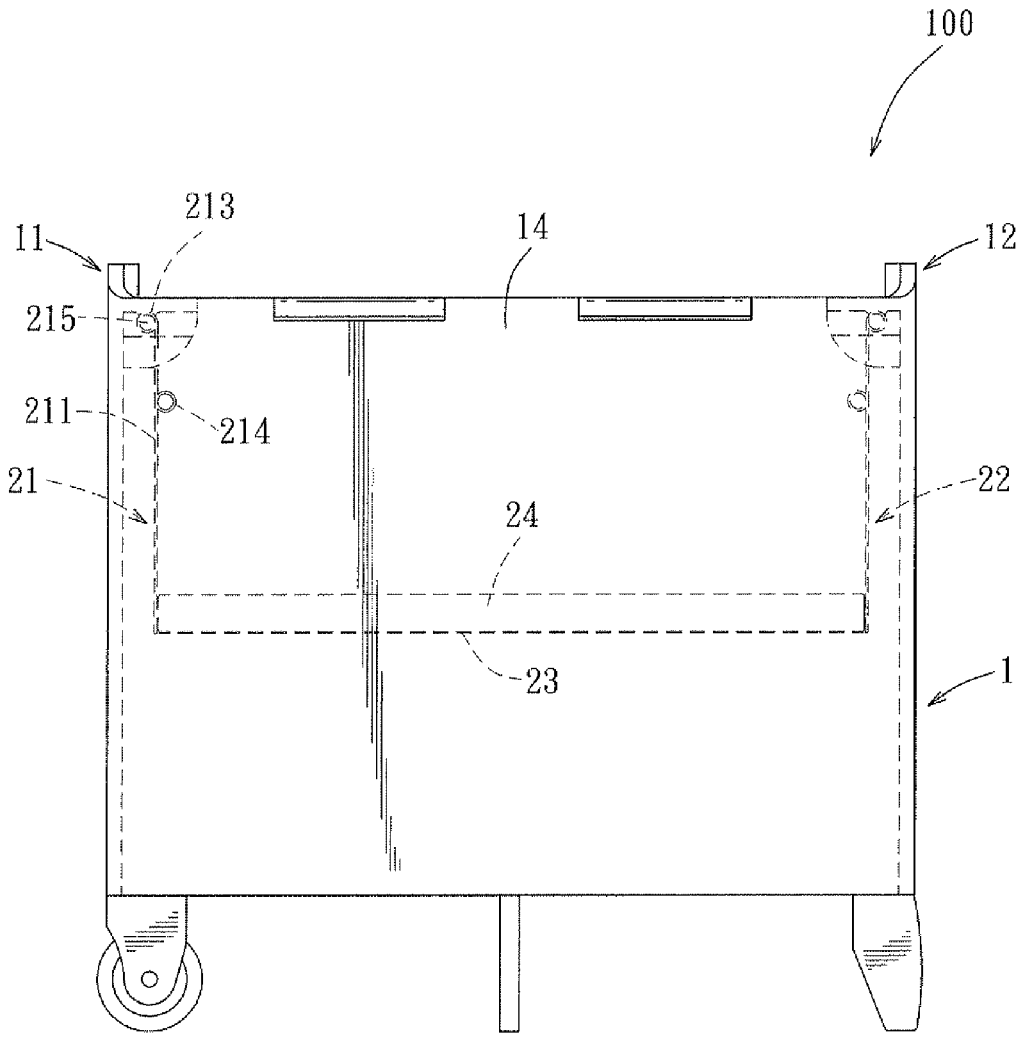
FIG. 3 is a side view of the first preferred embodiment when a head end of a bassinet is disposed at a first height position.

Referring to FIGS. 1 to 3, the first preferred embodiment of a play yard assembly 100 according to this invention includes a frame 1 and a bassinet 2 connected with the frame 1.

The frame 1 includes a frame head 11, a frame tail 12, and left and right side portions 13, 14 connected between the frame head 11 and the frame tail 12 to define an accommodating space 10 thereamong. In this embodiment, the frame head 11 includes a sidewall 111 and two connecting seats 112 disposed respectively on two opposite sides of a top end of the sidewall 111 and connected respectively to the left and right side portions 13, 14. Each of the connecting seats 112 is formed with a groove 113. The grooves 113 in the connecting seats 112 are open toward each other.

The bassinet 2 includes a head end 21, a tail end 22, a bed bottom 23 connected between the head end 21 and the tail end 22, and a mattress 24 disposed on the bed bottom 23.

The head end 21 includes an upright bassinet head sidewall 211, a plurality of hanging units 212 disposed at the bassinet head sidewall 211 at different heights, and a hanging rod 215. In this embodiment, the hanging units 212 are configured respectively as a horizontal first rod hole 213 disposed at a top end portion of the bassinet head sidewall 211, and a horizontal second rod hole 214 disposed under the first rod hole 213. In this embodiment, each of the first and second rod holes 213, 214 is defined by a tubular cloth material attached to the bassinet head sidewall 211, but is not limited thereto.

The hanging rod 215 extends through a selected one of the first and second rod holes 213, 214, and has two ends exposed outwardly of the selected one of the first and second rod holes 213, 214. When the hanging rod 215 extends through the first rod hole 213 and straddles between the connecting seats 112 in such a manner that the ends of the hanging rod 215 are received respectively within the grooves 113 in the connecting seats 112, the head end 21 of the bassinet 2 is disposed at a first height position shown in FIG. 3, and the second rod hole 214 is disposed below the connecting seats 112. In this position, the head end 21 and the tail end 22 of the bassinet 2 are at the same level so that the bed bottom 23 is horizontal. Hence, the mattress 24 is generally horizontal so that, when a baby lies on the mattress 24 of the bassinet 2, the head thereof is at the same level as the feet thereof.

Figure 4:
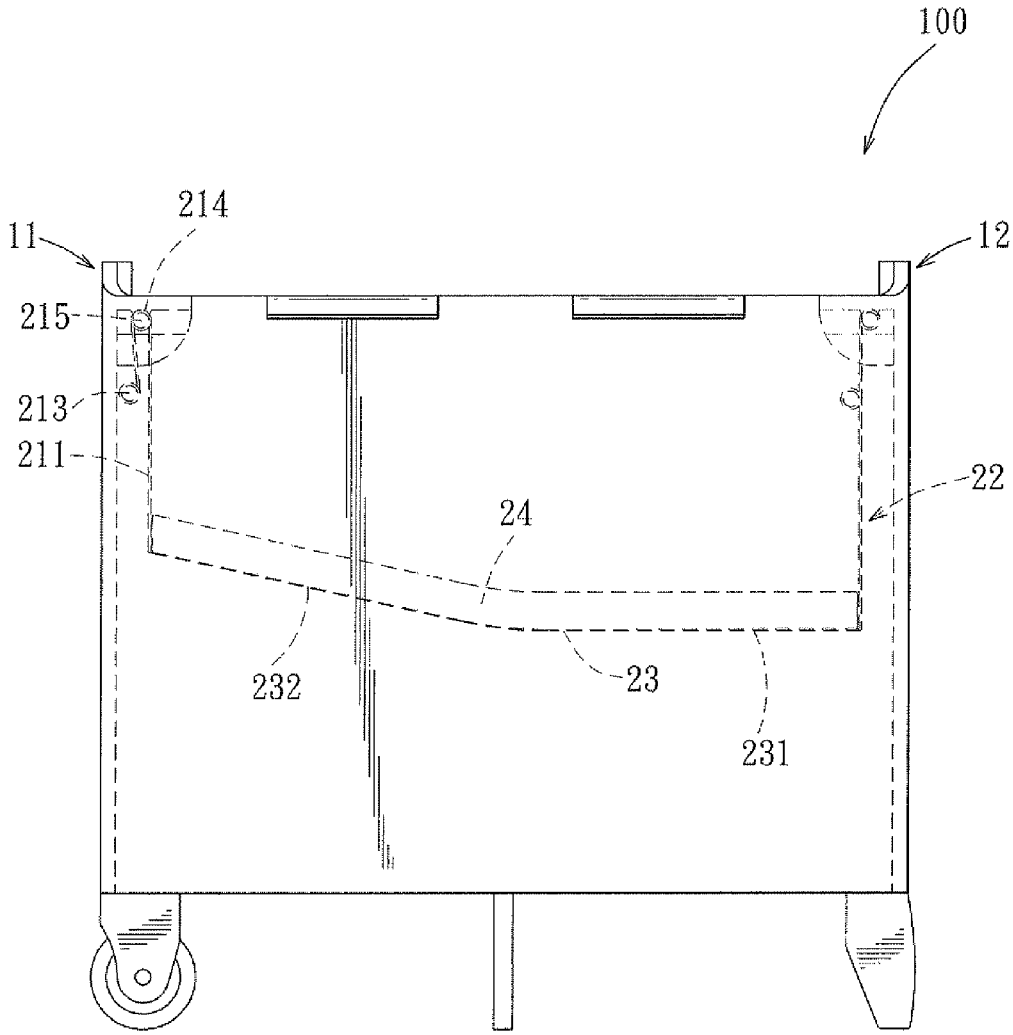
FIG. 4 is a side view of the first preferred embodiment when the head end of the bassinet is disposed at a second height position.

Referring to FIGS. 2 and 4, to allow the baby to lie on the bassinet 2 in such a manner to raise slightly the head of the baby, the hanging rod 215 is extended through the second rod hole 214, and the ends of the hanging rod 215 are hung respectively on the connecting seats 112. As such, the head end 21 is disposed at a second height position shown in FIG. 4 that is above the first height position. When the head end 21 is moved from the first height position to the second height position, since the bed bottom 23 is connected between the head end 21 and the tail end 22, and since the tail end 22 remains in situ, a first end portion 231 of the bed bottom 23 connected to the tail end 22 is blew an inclined second end portion 232 of the bed bottom 23 connected to the head end 21. Consequently, one end portion of the mattress 24 supporting the head of the baby is higher than the other end portion of the mattress 24 supporting the feet of the baby. That is, the head of the baby is raised.

Figure 5:
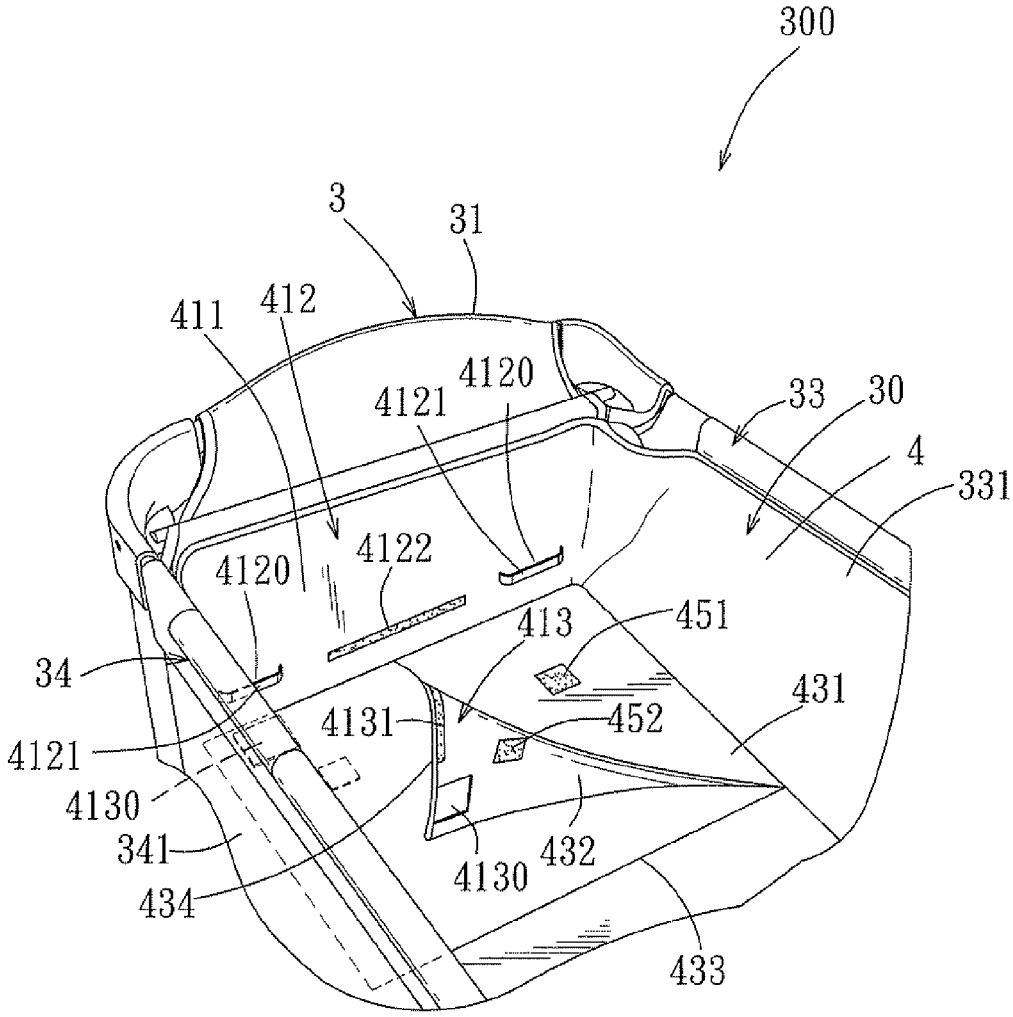
FIG. 5 is a fragmentary perspective view of the second preferred embodiment of a play yard assembly according to this invention.
Figure 6:
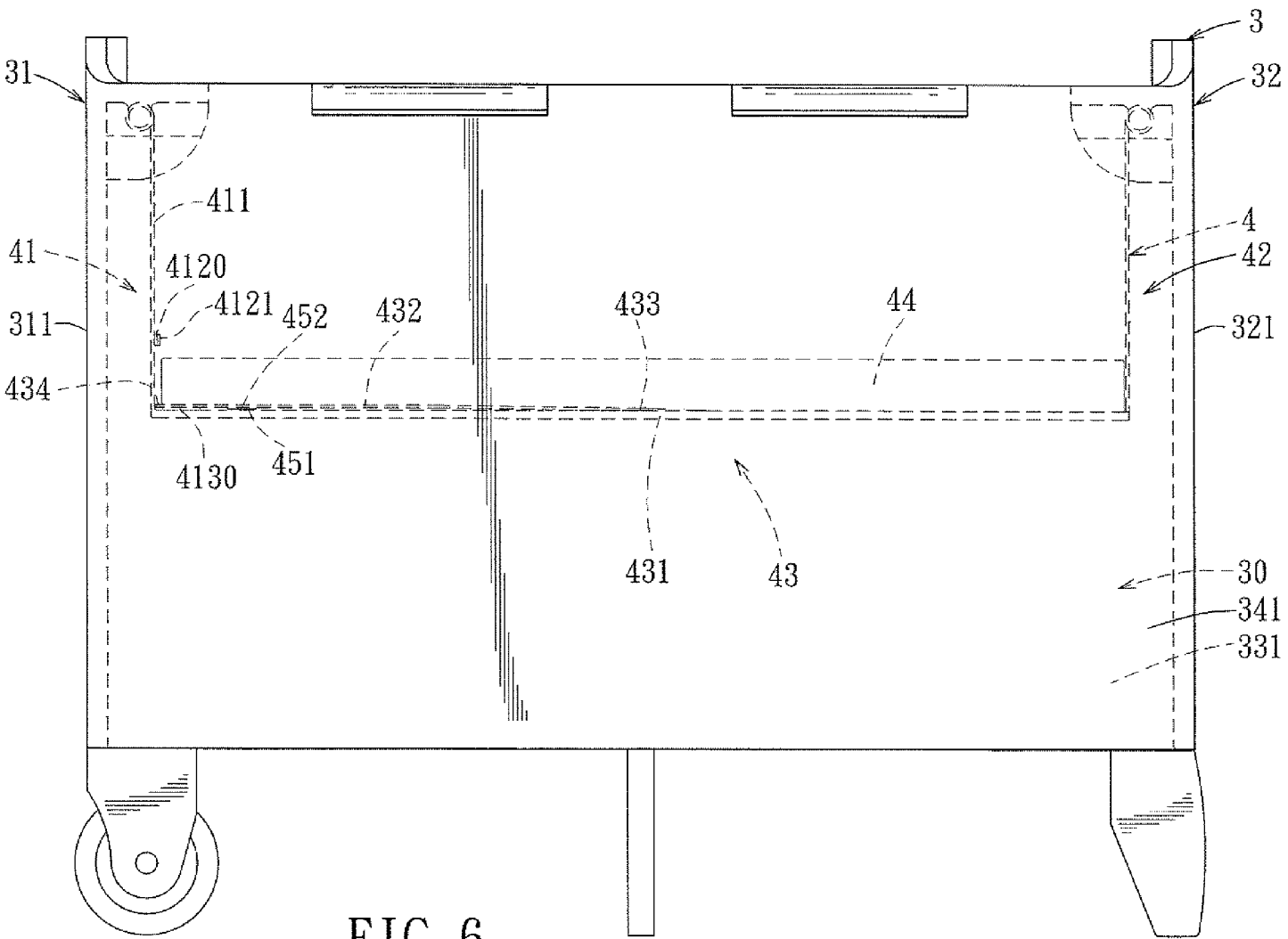
FIG. 6 is a side view of the second preferred embodiment when a head end of a bassinet is disposed at a first height position.

Referring to FIGS. 5 and 6, the second preferred embodiment of a play yard assembly 300 according to this invention includes a frame 3 and a bassinet 4.

The frame 3 includes a frame head 31, a frame tail 32, and left and right side portions 33, 34 connected between the frame head 31 and the frame tail 32 to define an accommodating space 30. Each of the frame head 31, the frame tail 32, and the left and right side portions 33, 34 includes an upright sidewall 311, 321, 331, 341. The sidewalls 311, 321, 331, 341 are interconnected to define an accommodating space 30.

The bassinet 4 includes a head end 41, a tail end 42, a bed bottom 43 connected between the head end 41 and the tail end 42, and a mattress 44 disposed on the bed bottom 43.

In this embodiment, the bed bottom 43 includes a first pad 431 connected between the head end 41 and the tail end 42, and a second pad 432 connected to a top surface of the first pad 431 by a plurality of first connecting members 451 disposed on the top surface of the first pad 431, and a plurality of second connecting members 452 disposed on a bottom surface of the second pad 432 and aligned respectively with the first connecting members 451. The first pad 431 has two ends connected respectively to the head end 41 and the tail end 42. The second pad 432 has a first end portion 433 and a second end portion 434. The first end portion 433 is sewn to an intermediate portion of the top surface of the first pad 43. The second end portion 434 is adjacent to the head end 41. In other words, the second pad 432 is connected to the first pad 431 at the first end portion 433, and is movable away from the first pad 431 at the second end portion 434.

Due to the presence of the first and second connecting members 451, 452, when the second pad 432 is laid flat on the first pad 431, it can be positioned on the same. In this embodiment, the first and second connecting members 451, 452 are interconnected hook-and-loop fasteners. Alternatively, the first and second connecting members 451, 452 may be of other structures that are interconnected removably.

The head end 41 of the bassinet 4 includes a bassinet head sidewall 411, a first coupling unit 412 disposed at an inner wall surface of the bassinet head sidewall 411, and a second coupling unit 413 disposed at the second end portion 434 of the second pad 432 and connectable with the first coupling unit 412. In this embodiment, the first coupling unit 412 includes two hanging grooves 4120 spaced apart from each other in a left-to-right direction and disposed at the inner wall surface of the bassinet head sidewall 411, and a hook-and-loop fastener 4122 disposed on the inner wall surface of the bassinet head sidewall 411 and disposed between the hanging grooves 4120. The hanging grooves 4120 are defined respectively by two cloth strips 4121, which are disposed on the bassinet head sidewall 411 at the same level and each of which has two ends sewn to the bassinet head sidewall 411. In particular, each of the hanging grooves 4120 is defined between the corresponding cloth strip 4121 and the bassinet head sidewall 411. The cloth strips 4121 are disposed above a juncture between the first pad 431 and the bassinet head sidewall 411.

In this embodiment, the second coupling unit 413 includes two hanging members 4130 spaced apart from each other in the left-to-right direction and connected fixedly to the second end portion 434 of the second pad 432, and a hook-and-loop fastener 4131 fastened to the second end portion 434 of the second pad 432 and disposed between the hanging members 4130. The hanging members 4130 are plates, and may be configured as hooks in another embodiment. Alternatively, the first and second coupling units 412, 413 may be interconnected adhesive materials, retainers, or hanging members, respectively.

When the hanging members 4130 are not inserted into the hanging grooves 4120, the second pad 432 is laid flat on the top surface of the first pad 431. In this state, due to the presence of the first and second connecting members 451, 452, the second pad 432 is positioned on the top surface of the first pad 431. Also in this state, the head end 41 is disposed at a first height position shown in FIG. 6, such that the bed bottom 43 and the mattress 44 disposed on the bed bottom 43 are horizontal. As such, when a baby lies on the mattress 44, the head and the feet thereof are at the same level.

Figure 7:
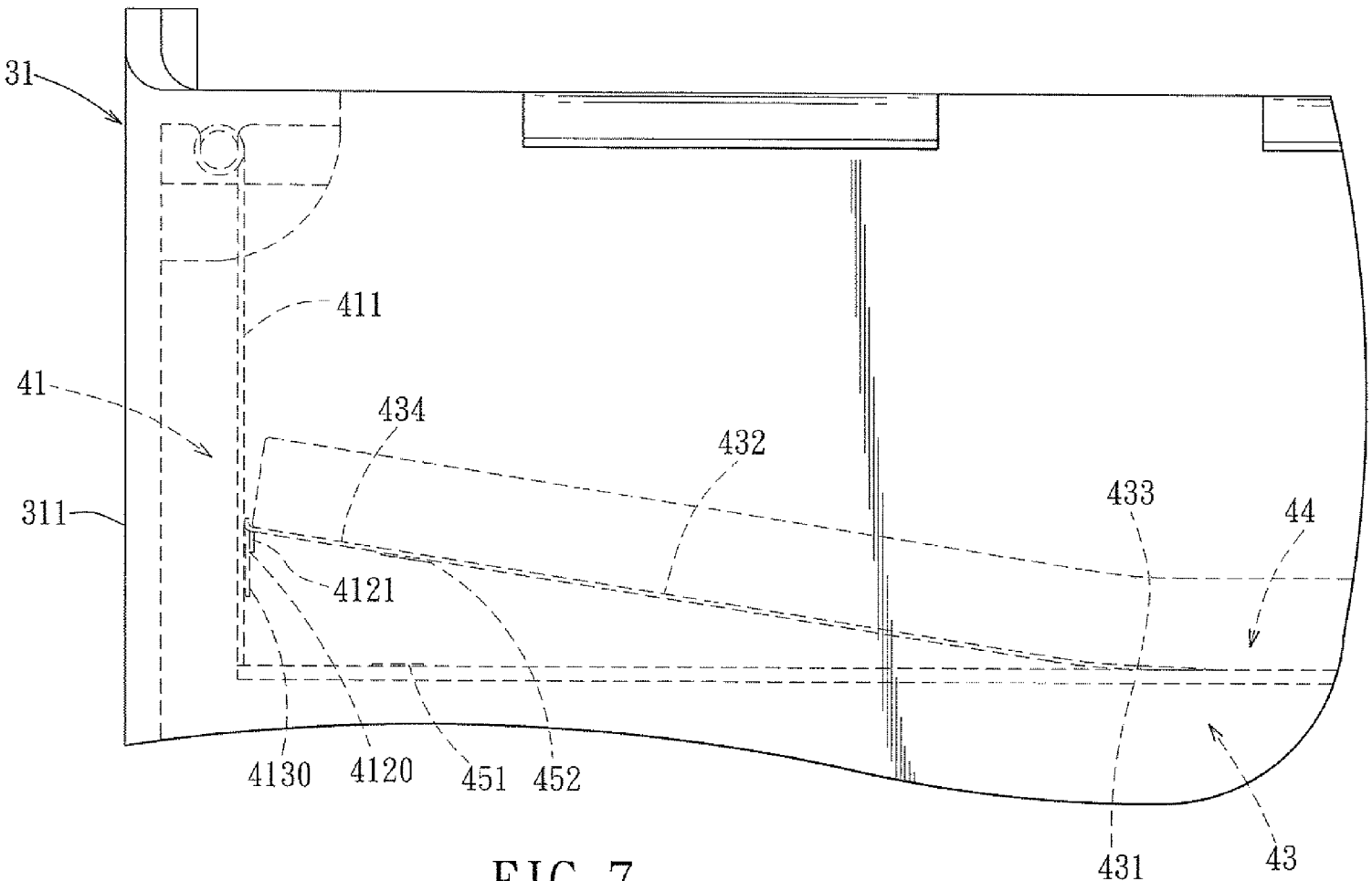
FIG. 7 is a side view of the second preferred embodiment when the head end of the bassinet is disposed at a second height position.

Referring to FIGS. 5 and 7, when it is desired to raise the head of the baby relative to the feet, the first and second connecting members 451, 452 are first removed from each other. Next, the second end portion 434 of the second pad 432 is pulled upwardly to engage the hanging members 4130 with the hanging grooves 4120, respectively, and to engage the hook-and-loop fastener 4131 of the second end portion 434 of the second pad 432 with the hook-and-loop fastener 4122 on the inner wall surface of the bassinet head sidewall 411. Hence, the head end 41 of the bassinet 4 can be maintained at a second height position shown in FIG. 7 relative to the frame head 11. In this position, the second end portion 434 of the second pad 432 is inclined, and one end portion of the mattress 44 adjacent to the head end 41 is raised relative to the other end portion thereof. As such, when the baby lies on the bassinet 4, the head of the baby is higher than the feet thereof.

Alternatively, the first and second coupling units 412, 413 may be replaced with interconnected snap buttons, retainers, hooks, or other removable structures.

In addition, the hanging grooves 4120 of the bassinet 4 and the hanging members 4130 of the second pad 432 may be applied to the first preferred embodiment.

In view of the above, the head end 21, 41 of the bassinet 2, 4 of the play yard assembly 100, 300 of this invention can be raised relative to the frame head 11, 31 to a higher position, so that the bassinet 2, 4 is inclined, such that the head end 21, 41 is above the tail end 22, 42, thereby allowing the baby to lie on the bassinet 2, 4 in such a manner that the head thereof is above the feet thereof.

With this invention thus explained, it is apparent that numerous modifications and variations can be made without departing from the scope and spirit of this invention. It is therefore intended that this invention be limited only as indicated by the appended claims.

We claim:

1. A play yard assembly comprising:

a frame including a frame head, a frame tail, and left and right side portions connected between said frame head and said frame tail to define an accommodating space thereamong;

a bassinet having a head end, a tail end, bed bottom connected between said head end and said tail end, said head end being positionable relative to said frame at a first height position and a second height position higher than the first height position;

said bed bottom having a first end portion connected to said tail end, and a second end portion connected to said head end and said first end portion wherein said second end portion of said bed bottom is higher than said first end portion of said bed bottom when said head end is disposed at said second height position, and wherein said first and second end portions are flat and form an obtuse angle therebetween;

wherein said head end of said bassinet includes a bassinet head sidewall and a plurality of hanging units disposed at said bassinet head sidewall at different heights, a selected one of said hanging units being connected to said frame head so as to locate said head end of said bassinet at a corresponding one of the first and second height positions; and wherein said hanging units are configured respectively as a first rod hole and a second rod hole disposed under said first rod hole, said head end of said bassinet further including a hanging rod extending through a selected one of said first and second rod holes and hung on said frame head, said hanging rod extending through said first rod hole when said head end of said bassinet is disposed at the first height position, and said hanging rod extending through said second rod hole when said head end of said bassinet is disposed at the second height position.

2. The play yard assembly as claimed in claim 1, wherein said frame head includes a sidewall, and two connecting seats disposed respectively on two opposite sides of said sidewall of said frame head and connected respectively to said left and right side portions, said hanging rod having two ends exposed outwardly of the selected one of said first and second rod holes and hung respectively on said connecting seats.

3. The play yard assembly as claimed in claim 2, wherein each of said connecting seats is formed with a groove permitting a corresponding one of said ends of said hanging rod to be received therein.

4. A play yard assembly comprising:

a frame including a frame head, a frame tail, and left and right side portions connected between said frame head and said frame tail to define an accommodating space thereamong;

a bassinet having a head end, a tail end, bed bottom connected between said head end and said tail end, said head end being positionable relative to said frame at a first height position and a second height position higher than the first height position;

said bed bottom having a first end portion connected to said tail end, and a second end portion connected to said head end and said first end portion wherein said second end portion of said bed bottom is higher than said first end portion of said bed bottom when said head end is disposed at said second height position, and wherein said first and second end portions are flat and form an obtuse angle therebetween; and wherein said bed bottom includes a first pad and a second pad connected to a top surface of said first pad, said second pad having a first end portion connected to said first padand a second end portion adjacent to said head end of said bassinet, said head end of said bassinet including a bassinet head sidewall, a first coupling unit disposed at an inner wall surface of said bassinet head sidewall and located above said first pad, and a second coupling unit disposed at said second end portion of said second pad and movable to connect with said first coupling unit so that said second end portion of said second pad is higher than said first end portion of said second pad.

5. The play yard assembly as claimed in claim 4, wherein said first coupling unit includes at least one hanging groove, and said second coupling unit includes at least one hanging member engaging said hanging groove.

6. The play yard assembly as claimed in claim 5, wherein said first coupling unit further includes a hook-and-loop fastener, and said second coupling unit further includes a hook-and-loop fastener engaging said hook-and-loop fastener of said first coupling unit.

7. The play yard assembly as claimed in claim 6, wherein said bed bottom further includes at least one first connecting member disposed on said first pad, and at least one second connecting member disposed on said second pad and connected removably to said first connecting member.

8. The play yard assembly as claimed in claim 5, wherein said bed bottom further includes a first connecting member disposed on said first pad, and a second connecting member disposed on said second pad and connected removably to said first connecting member.

9. The play yard assembly as claimed in claim 8, wherein said first and second connecting members are configured as hook-and-loop fasteners.

10. The play yard assembly as claimed in claim 5, wherein said first coupling unit further includes at least one cloth strip having two ends fastened to said inner wall surface of said bassinet head sidewall to define said hanging groove.

11. The play yard assembly as claimed in claim 5, wherein said hanging member is configured as a plate.

* * * * *